United States Patent [19]

Liebowitz et al.

[11] 4,414,144

[45] Nov. 8, 1983

[54] AQUEOUS SKIN CLEANER CONTAINING HYDROXYPROPYLATED GUAR GUM AND PARAFFIN SULFONATE/ALKYL SULFATE DETERGENT MIXTURE

[75] Inventors: Marvin Liebowitz, Edison; Charles Buda, Middlesex, both of N.J.

[73] Assignee: Colgate-Palmolive Co., New York, N.Y.

[21] Appl. No.: 335,990

[22] Filed: Dec. 30, 1981

[51] Int. Cl.[3] ..... C11D 1/14; C11D 3/22

[52] U.S. Cl. ..... 252/548; 252/550; 252/552; 252/554; 252/174.17; 252/174.24; 252/DIG. 5; 252/DIG. 13; 252/DIG. 14

[58] Field of Search ..... 252/550, 552, 554, 548, 252/174.17, 174.24, DIG. 5, DIG. 13, DIG. 14; 424/70

[56] References Cited

U.S. PATENT DOCUMENTS

| | | | |
|---|---|---|---|
| 3,325,416 | 6/1967 | Hewitt | 252/550 |
| 3,928,249 | 12/1975 | Nunziata et al. | 252/526 |
| 4,102,826 | 7/1978 | Renaud | 252/548 |
| 4,298,494 | 11/1981 | Parslow et al. | 252/174.16 |
| 4,330,438 | 5/1982 | Dierassi et al. | 252/552 |
| 4,338,211 | 7/1982 | Stiros | 252/142 |

FOREIGN PATENT DOCUMENTS 1419116 12/1975 United Kingdom .

OTHER PUBLICATIONS

"Polymers For Personal Care Products," Celanese Plastics & Specialties Company, Application Bulletin, pp. 1-3.

Res. Disclosure, (GB), 18412, No. 184 (Aug. 1979) p. 413.

*Primary Examiner*—P. E. Willis, Jr.

*Attorney, Agent, or Firm*—Herbert S. Sylvester; Murray M. Grill; Norman Blumenkopf

[57] ABSTRACT

An aqueous liquid skin cleaning composition containing hydroxypropylated guar gum, paraffin sulfonate, and $C_{8-16}$ alkyl sulfate, and a method of washing the skin therewith.

9 Claims, No Drawings

AQUEOUS SKIN CLEANER CONTAINING HYDROXYPROPYLATED GUAR GUM AND PARAFFIN SULFONATE/ALKYL SULFATE DETERGENT MIXTURE

This invention relates to a liquid skin cleaning composition, and especially to such compositions which when employed for washing skin in the presence of water yield a quick flash foam with creamy bubbles and leave the washed, dried skin with a smooth, soft, satisfying feel.

Liquid skin cleaning compositions adapted for washing skin in presence of water have been in use for a number of years, generally being based on combinations of surfactants, emollients, moisturizers, perfumes and preservatives. Such compositions are for example widely employed in pump-type dispensers suspended over a water faucet sink and adapted to dispense a controlled quantity of the liquid cleaning composition on the hands upon activating the pump valve. Usually, however, these compositions do not perform as well as could be desired, being typically deficient with respect to unsatisfactory or sluggish cutoff at the pump nozzle, undue delay in foam formation, watery or thin foam feel and/or unsatisfying unlubricated dry feel of the washed and dried skin and the like.

It is an object of this invention to provide liquid cleaning compositions and methods which will not be subject to one or more of the above deficiencies. Other objects and advantages will appear as the description proceeds.

The attainment of the above objects is made possible by this invention which includes the provision of a liquid skin cleaner composition comprising an aqueous medium containing, approximately by weight, I. 0.05 to 1.0% of hydroxypropylated guar gum, II. 10 to 20% of a mixture of (A) A water soluble paraffin sulfonate salt and (B) A water soluble $C_8$-16 alkyl sulfate salt, the ratio of A/B ranging from 3:1 to 1:3, and;

III. At least 50% of water.

Also provided according to the invention is a method comprising washing the skin with the above defined composition, generally in the presence of water.

The compositions of this invention have been found to exhibit a quick and complete cutoff at the pump nozzle of the conventional pump type dispensers, yield a quick, creamy foam, provide highly effective detergency, and leave the washed, dried skin with a soft, smooth feel.

Component I in the composition of this invention employed in proportions of about 0.05 to about 1.0, preferably about 0.1 to about 0.5, wt.%, is a nonionic hydroxypropyl (HP) guar gum derivative functioning not only as a thickener but also as a foam booster. Aforesaid devivative is prepared by hydroxypropylating guar gum. Guan gum, chemically classified as a galactomannan, is a high molecular weight carbohydrate polymer essentially comprising a straight chain mannan branched at quite regular intervals with single membered galactose units on alternate mannose units, as disclosed in Jaguar catalogue of the Stein-Hall Company, The HP guar gum derivatives utilized in the present invention are water soluble, dry, particulate, carbohydrate materials having a particle size such that a minimum of 90% passes through a 140 mesh U.S. standard sieve and an MS (moles of substitution) value in the range of 0.2 to 0.8, preferably from 0.3 to 0.65. Generally, 1% aqueous solutions thereof have a pH in the range of 5 to 11 and a viscosity of about 3000 to 4000 cps measured on a Brookfield RVF viscometer using a No. 3 spindle rotating at 20 RPM at a temperature of 25° C., and the resultant solutions are thixotropic as viscosity changes with shearing stress. Suitable HP guar gum derivatives may be obtained from Stein-Hall Company under the names Jaguar ®HP 60, Jaguar ®HP 8 and Jaguar ®HP 11, which usually contain 5–13%, preferably 8–10% moisture as received.

The HP guar gum derivatives are known to have thickening properties in aqueous solutions. However, a thickening agent is not generally known to improve the foaming properties of aqueous solutions containing surfactants, whereas the HP guar gum derivative defined above, both increases the viscosity of these compositions as well as improves their foaming performance.

U.S. Pat. Nos. 3,748,201 and 3,700,612 disclose hydroxypropylated guar gum as thickening agents, but only in printing pastes, paint dispersions and explosive slurries.

These compositions contain about 10 to about 20, preferably about 12 to about 15, wt% of the defined component II mixture of A and B anionic surfactant detergents, as substantially the sole detergent active agents therein. The paraffin sulfonate of component A is per se well known, as are methods for its production. The paraffin or alkane surfonate generally comprises a mixture of alkyls varying in chain length from about 10 to about 20 or more preferably about 12 to about 18, carbon atoms, produced by reaction of the precursor alkane hydrocarbon mixture with sulfur dioxide, sulfonyl chloride or other sulfonating reactant, or by reaction of the precusor alkene hydrocarbon mixture with a bisulfate, both optimally with catalyst and/or in itiator. It is normally desirable to produce the monosulfonate, with little or no unreacted hydrocarbon precursor or inorganic salt by-product. The sulfonate group or groups may be bonded to the terminal and/or internal carbon atoms of the chain. Small amounts of disulfonated products are generally also produced, especially with use of an excess of sulfonating agent. Some trisulfonates and higher sulfonated products may also be present, but usually in very small amounts. Unreacted paraffin and by-product sulfate, usually a soluble in organic sulfate such as with sodium, potassium or other salt forming cation referred to below may be present in measurable quantity but do not appear to be significantly detrimental in the compositions of this invention.

The alkyl sulfate of component B is likewise per se well known, as are methods for its production. The alkyl moiety may contain about 8 to about 16, preferably about 10 to about 14, especially about 12, carbon atoms and may be unsaturated but preferably saturated, and branched but preferably straight chain.

The proportion of A/B in the component II mixture may range from about 3/1 to about 1/3, preferably about 2/1 to about 1/2, especially about 1/1. Both components A and B are present in the form of salts with water-solubilizing cations such as ammonium, lower alkyland alkanolammonium (e.g. $C_{2-4}$ alkyland alkanol) such as mono-, di-, tri-, -methyl-, -ethyl-, -isopropanol-, -propanol-, or -ethanolammonium, and alkali metal such as potassium or especially sodium. The sodium salts are preferred.

The composition of this invention preferably and almost essentially contain about 4 to 15, preferably about 5 to about 12, especially about 6 to about 10, wt% of one or preferably mixture of $C_{10-18}$ fatty acid lower alkanolamides. The preferred mixture preferably comprises at least one monoalkanolamide and at least one dialkanolamide in a ratio of about 4/1 to about 1/4, preferably about 2/1 to about 1/2, especially about 1/1. The fatty acid moiety may be derived from one or, more typically a mixture of fatty acids, unsaturated and/or branched but preferably all or predominantly straight chain and saturated, of about 10 to about 18 carbon atoms, such as lauric, myristic, palmitic and/or stearic acids as present for example in vegetable and animal fats and oils, e.g. coconut oil, palm oil, tallow and the like, or as synthetically produced. The lower alkanol moiety may be one or a mixture of $C_{2-4}$ alkanols such as butanol, propanol, their isomeric forms, and preferably ethanol. A conventional highly preferred dialkanolamide is commonly referred to as lauric-myristic diethanolamide (LMDEA) which is really a mixture of lauric and myristic diethanolamides in a ratio of about 3/1 to about 1/3, preferably about 1/1. A highly preferred monoalkanolamide component is coco (fatty acid) monoethanolamide. Some alternates or variants of the above include for example lauric-myristic monoethanolamide and monoisopropanolamide, coco diethanolamide and the like.

Another desirable component of the compositions of this invention is one or a mixture of skin beneficiators, e.g. skin conditioners, moisturizers, emollients, softeners and the like, some of which may also function as humectants, solvents, surfactants, thickeners, viscosity stabilizers, opacificers and the like, typically in proportions of about 1 to about 10 wt%. A particularly useful agent of this type is ethylene glycol distearate, an emollient and opacifier, typically in proportions of about 2 to about 5 wt.%. Lanolin and its derivatives are likewise deemed especially useful agents of this type for making compositions in accordance with the teachings of this invention. A detailed list of these and other skin beneficiators can be found in U.S. Pat. No. 4,246,285 issued Jan. 20, 1981, in the passage from column 2, line 31 to column 2, line 58, which passage is incorporated herein by reference thereto. Another useful skin softener and conditioner is Merquat 550 (Merck quaternium 41, 8% aqueous solution of highly charged cationic copolymer of acrylamide and dimethyldiallyl ammonium chloride) in proportions of about 0.25 to about 5 wt.%.

Still another desirable component of these compositions is one or a mixture of organic humectants such as glycerin and the like in proportions of about 0.25 to about 3 wt.%. Humectants, which may also function as solvents, skin beneficiators and the like, are typically polyhydric alcohols, including polyether polyols, examples of which are disclosed at column 3, lines 19 to 32, which discussion is again incorporated here for this purpose. Another useful humectant is PPG (10) methyl glucose ether (polypropylene glycol (10) methyl glucose ether).

The compositions of this invention are preferably provided in the form of a viscous cream, e.g. with a viscosity of about 1500 to 2500, especially about 2,000 cps. The HP guar gum thickener component I is peculiarly effective for this purpose. The primary function of the fatty acid alkanolamides is for foam stabilization, the dialkanolamides further coacting with the component I thickener to provide viscosity stabilization. The HP guar gum component I is for example surprisingly more effective than other thickening agents such as hydroxypropyl methyl cellulose in enabling quicker and more complete cutoff at the pump dispenser nozzle. The component II mixture, especially in the presence of component I, provides improved wetting, detergent and foam properties.

Other conventional additives may be included such as preservatives, colorants, bacteriostats, fragrances, solvents such as ethanol, and the like.

The following example is only illustrative of a preferred embodiment of this invention and is not to be regarded as limitative. All amounts and proportions referred to herein and in the appended claims are by weight unless otherwise indicated.

| | Weight % |
|---|---|
| Jaguar HP-60* | 0.20 |
| Citric acid solution (50% aq.)** | 0.04 |
| Sodium lauryl sulfate | 6.00 |
| Sodium paraffin sulfonate | 7.20 |
| Coco monoethanolamide | 4.00 |
| Ethylene glycol distearate | 3.00 |
| Glycerin | 0.50 |
| Solulan 75*** | 0.50 |
| Lauric myristic diethanolamide | 4.00 |
| Preservative | 0.10 |
| Fragrance | 0.25 |
| Water, q.s. to | 100 |

*Hydroxypropylated guar gum, Stein Hall
**pH 7 buffer, HP-60 hydrater
***Polyoxyethylenated (75) lanolin, water soluble, Amerchol Corp.

The above formulation is charged into a pump type dispenser over a water faucet sink. Hands are wetted with water, the pump valve activated to discharge an effective amount of the formulation on the hand, the hands washed therewith optimally with a little more water, and then rinsed and dried. The formulation, a viscous cream, cuts off quickly, cleanly, and completely at the pump nozzle, produces a quick flash foam with creamy bubbles on the hands for washing, and leaves the washed and dried skin with a smooth, soft, satisfying feel.

This invention has been disclosed with respect to certain preferred embodiments and it will be understood that modifications and variations thereof obvious to those skilled in the art are to be included within the sprit and purview of this application and the scope of the appended claims.

We claim:

1. A liquid skin cleaner composition comprising an aqueous medium containing, approximately by weight I. 0.05 to 1.0% of hydroxypropylated guar gum, II. 10 to 20% of a mixture of (A) A water soluble paraffin sulfonate salt and (B) A water soluble $C_{8-16}$ alkyl sulfate salt, the ratio of A/B ranging from 3/1 to 1/3, and III. At least 50% of water.

2. A composition according to claim 1 further containing about 4 to about 15 wt.% of at least one $C_{10-18}$ fatty acid lower alkanolamide component.

3. A composition according to claim 2 wherein said alkanolamide component comprises a 4/1 to 1/4 mixture of monoalkanolamide and dialkanolamide.

4. A composition according to claim 3 wherein said monoalkanolamide is coco monoethanolamide in an amount about equal to said dialkanolamide which is lauric myristic diethanolamide.

5. A composition according to any of claims 1 to 4 wherein component B is sodium lauryl sulfate.

6. A composition according to any of claims 1 to 4 containing about 0.1 to about 0.5 wt.% of hydroxypropylated guar gum, about 12 to about 15 wt.% of said component II mixture, about 70 to about 80 wt.% of water, sodium laurylsulfate as component B, and a ratio of A/B of about 1/1.

7. A method comprising washing the skin with water and a composition according to any of claims 1 to 4.

8. A method comprising washing the skin water and with a composition according to claim 5.

9. A method comprising washing the skin with water and a liquid skin cleaner composition according to claim 1 comprising an aqueous medium containing approximately by weight, 0.1 to 0.5 wt. % of hydroxypropylated guar gum, 12 to 15 wt. % of an about 1/1 mixture of sodium paraffin sulfonate and sodium lauryl sulfate, 4 to 15 wt. % of a 4/1 to 1/4 mixture of monoloweralkanolamides and diloweralkanolamides of $C_{10}$-$C_{18}$ fatty acids, and 70 to 80 wt. % of water.

* * * * *